United States Patent [19]

Scheid et al.

[11] 4,305,426

[45] Dec. 15, 1981

[54] APPARATUS FOR CONTINUOUS CONSTANT DISCHARGE OF LIQUID FROM A CONTAINER

[75] Inventors: Helmut Scheid, Zollhaus; Dietrich Strohmaier, Limburg, both of Fed. Rep. of Germany

[73] Assignee: Passavant-Werke Michelbacher Huette, Fed. Rep. of Germany

[21] Appl. No.: 96,243

[22] Filed: Nov. 20, 1979

[30] Foreign Application Priority Data

Nov. 20, 1978 [DE] Fed. Rep. of Germany ..... 2850224

[51] Int. Cl.[3] ..... G05D 11/00

[52] U.S. Cl. ..... 137/578; 137/101.29; 137/579

[58] Field of Search ..... 137/101.27, 101.29, 137/395, 398, 577, 577.5, 578, 579

[56] References Cited

U.S. PATENT DOCUMENTS

| | | | |
|---|---|---|---|
| 213,920 | 4/1879 | McKissock | 137/398 |
| 359,461 | 3/1887 | Newell | 137/578 |
| 947,325 | 1/1910 | Callaway | 137/578 |
| 1,115,791 | 11/1914 | Drew | 137/398 |
| 1,536,057 | 5/1925 | Bartlett | 137/101.29 |
| 1,536,061 | 5/1925 | Bartlett | 137/101.29 |
| 1,990,501 | 2/1935 | Poirier | 137/398 |
| 2,178,477 | 10/1939 | Johnson | 137/578 |

FOREIGN PATENT DOCUMENTS

| | | | |
|---|---|---|---|
| 731965 | 6/1955 | United Kingdom | 137/578 |

*Primary Examiner*—Martin P. Schwadron
*Assistant Examiner*—G. L. Walton
*Attorney, Agent, or Firm*—Woodford R. Thompson, Jr.

[57] ABSTRACT

This invention relates to apparatus for continuously discharging liquid from a container, such as a waste water tank having a discharge pipe with an inlet located adjacent the container floor and an outlet located outwardly of the container. The liquid flow is controlled by a control unit which operates as a function of the liquid level in the container. The discharge pipe has a riser section between its inlet and its outlet which extends upwardly to an apex section to define an overflow for the liquid. The riser section is adjustable in height which is controlled by control means that always maintains the overflow at a constant elevation below the liquid level in the container.

9 Claims, 11 Drawing Figures

FIG. 8
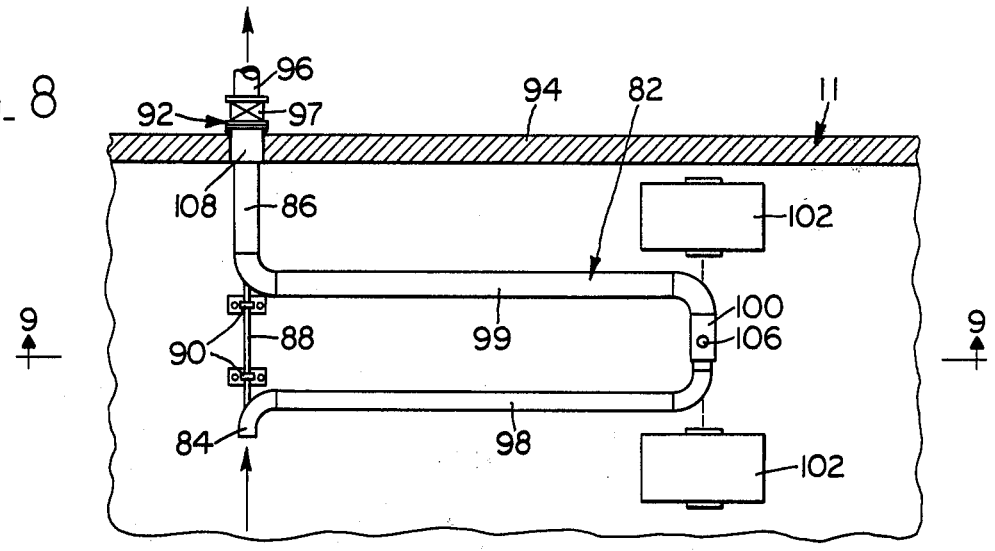
FIG. 9
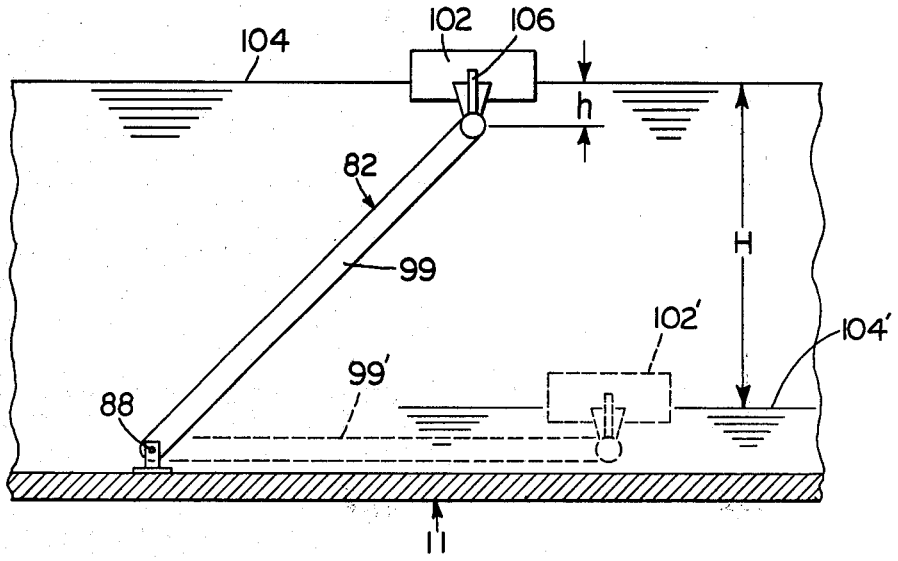
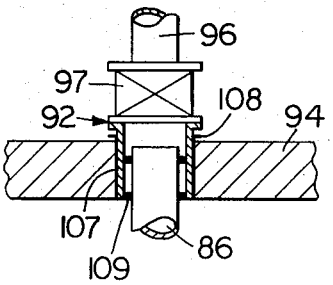
FIG. 10
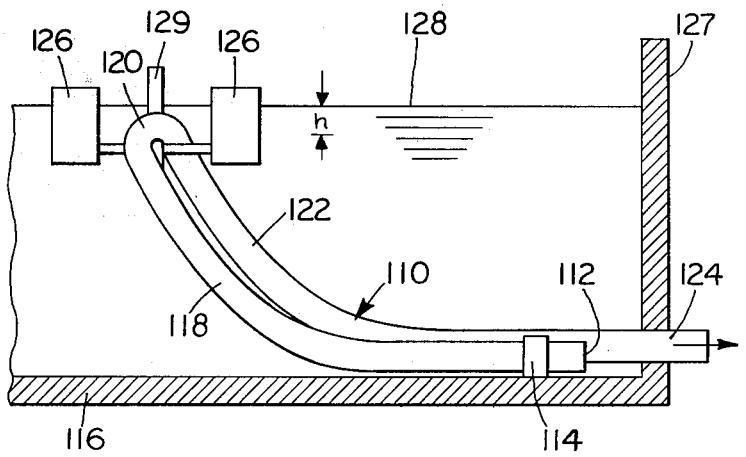
FIG. 11

APPARATUS FOR CONTINUOUS CONSTANT DISCHARGE OF LIQUID FROM A CONTAINER

BACKGROUND OF THE INVENTION

It is known that the volume of liquid flowing from a vessel having a fluctuating liquid level therein through an opening in the vicinity of the base of the vessel is not constant over a period of time, but varies proportionally to the square root of the height of the liquid level in the vessel. In many cases it is desirable to maintain a continuous liquid discharge from a vessel or tank that is constant over a period of time, regardless of the varying height of the liquid level. Examples of this are storm water retention tanks, located ahead of waste water treatment plants and adapted to store quantities of waste water which increase considerably under storm weather conditions and thus exceed the capacity of the treatment plant. Depending on the volume of rainfall, the liquid level in such storm water retention tanks can fluctuate greatly and at the same time, the liquid from the tank is to be discharged at a level as constant as possible into the treatment plant, according to the maximum capacity of the plant.

The discharge of liquid at a constant level over a time period from the vicinity of the surface of the liquid in a tank can be effected by a floating inlet following the fluctuations in the liquid level. However, in the case of storm water retention tanks and in many other cases it is necessary to locate the liquid discharge as low as possible in the vicinity of the base of the tank. For such cases it is known that valve control devices such a butterfly valves, butterfly flaps, pneumatic valves or the like, can be located in the discharge pipe. These are controlled by floats or other control members, depending on the liquid level in the tank, and provide a constant discharge quantity over a time period by relative variation of the flow cross section of the discharge pipe.

Difficulties have been encountered with these devices due to the fact that the control is relatively inaccurate as it is difficult to achieve a variation of the flow cross section, proportional to the square root of the liquid height in the tank. Also, the fluctuating friction and vortex losses in the pipe and in the butterfly valve control device are very difficult to calculate. In addition, butterfly valve control devices are subject to wear and blockage due to pollutants in the waste water. Furthermore, such prior art devices are often very expensive, especially if precise electrically controlled butterfly units are used.

SUMMARY OF THE INVENTION

The purpose of the invention is to provide control apparatus for maintaining a constant discharge from a tank which can be made very simply and economically. At the same time, the control apparatus provides a very exact and constant value of the quantity of liquid withdrawn over a period of time and is resistant to wear and blockage.

In accordance with our invention, the quantity of liquid being discharged is achieved by the height difference between an overflow and the liquid level in a tank being kept constant. This is in itself known by means of floating inlets in the case of liquid withdrawal from a liquid surface but heretofore could not be reconciled with the requirement that the liquid should be withdrawn in the vicinity of the base of the tank or container. The control apparatus according to our invention operates more accurately than prior art apparatus due to the principles of operation employed. With our invention, all parameters determining the flow quantity, including the height difference determining the discharge pressure, can be kept constant. In the case of prior art butterfly valve control units one of the parameters in each case, namely the flow cross section of the discharge pipe, must be changed by another variable parameter, namely the height difference. The apparatus according to our invention, can be operated with an unchanging cross sectional flow which can be selected in sufficiently large size as to be unaffected by blockage. In addition, it is very simple in design, economical of manufacture, and reliable in operation.

DESCRIPTION OF THE DRAWINGS

Apparatus embodying features of our invention is illustrated in the accompanying drawings, forming a part of this application, in which:

FIG. 8 is a plan view showing a further embodiment of our invention;

FIG. 9 is a sectional view taken generally along the line 9—9 of FIG. 8;

FIG. 10 is a fragmental view showing a detail of the apparatus shown in FIG. 8; and FIG. 11 is a side elevational view, showing a still further embodiment of our invention, with parts being shown in section.

DETAILED DESCRIPTION

Figure 1:
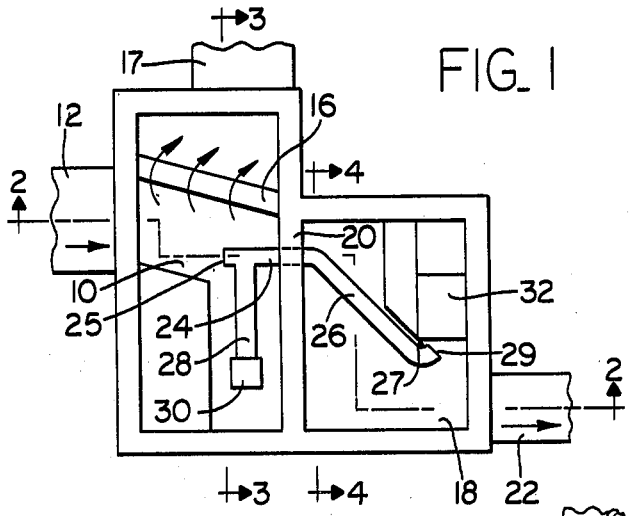
FIG. 1 is a top plan view showing one embodiment of our invention.
Figure 2:
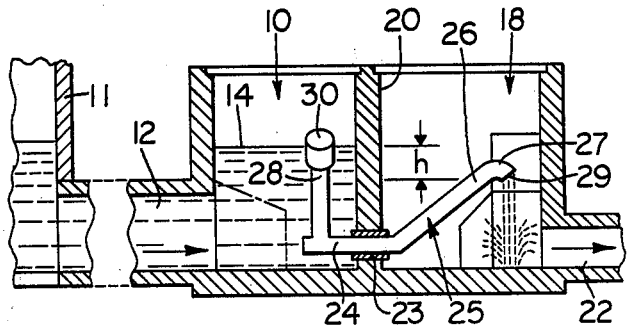
FIG. 2 is a sectional view taken generally along the line 2—2 of FIG. 1 and showing a fragment of a storm water retention tank.
Figure 3:
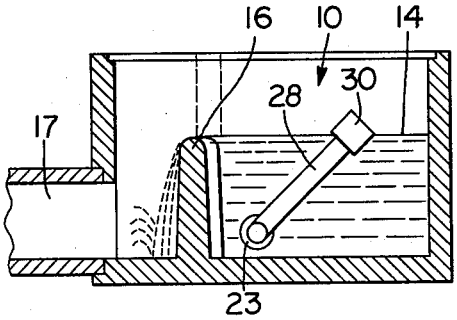
FIG. 3 is a sectional view taken generally along the line 3—3 of FIG. 1.
Figure 4:
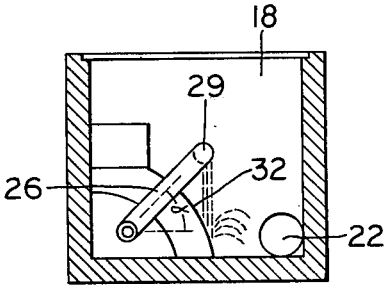
FIG. 4 is a sectional view taken generally along the line 4—4 of FIG. 1.

Referring now to the drawings, we show in FIGS. 1 to 4 a discharge chamber 10 which communicates with a storm water retention tank 11 of a sewage treatment plant by means of a channel or conduit 12. Accordingly, the same liquid level 14 is obtained in the chamber 10 as in the storm water retention tank 11. This liquid level 14 can fluctuate considerably between a very low level during dry weather and a higher level obtained under very heavy rainfall, this being determined by an overflow weir 16 in the chamber 10. Waste water which flows over the overflow weir 16 under very heavy rainfall passes into the receiving water course by a channel or conduit 17, thus by-passing the treatment plant.

The discharge chamber 10 is separated from a receiving chamber 18 by a wall 20, with a channel or conduit 22 communicating the chamber 18 with a treatment plant, not shown. A horizontal section 24 of a discharge pipe 25 extends through and is adapted for pivotal movement within a bearing bushing 23 which is positioned within an opening through the wall 20 so as to provide a seal. Connected to the horizontal section 24 within the receiving chamber 18 is an upwardly extending riser section 26 of the discharge pipe 25 which is inclined relative to the horizontal section at an angle of, for example, 40°. The riser section 26 extends to an apex section 27 which has a discharge opening 29 immediately below the apex section. Connected to and extending at right angles to the horizontal section 24 within the discharge chamber 10 is a pipe arm section 28 which ascends at right angles to the horizontal section 24 and carries an air filled float 30 at its uppermost end. The pipe arm section 28 carring the float 30 and the riser section 26 are both fixed to the horizontal section 24 so that they rotate as a unit about the axis of the bearing bushing 23 and preferably lie in one common plane. The float 30 moves in response to and follows the fluctuations of the liquid level 14 in the chamber 10 and at the same time moves the riser section 26 of the discharge pipe 25 so that the lower inner edge of the opening 29 in the apex section 27 defines an overflow which always lies at a constant height difference "h" (FIG. 2) below the liquid level 14. This height difference "h" is selected in such a way by suitable dimensioning of the dimensions of the pipe arm section 28 and the inclined section 26 that sufficient discharge pressure is always obtained at the discharge opening 29. Furthermore, the dimensions should preferably be so selected that the included angle α (FIG. 4) between the riser section 26 or the pipe arm section 28 and a horizontal plane through the pivot axis of the discharge pipe 25, even when the liquid level in the tank is at a maximum, is no greater than 45°. In this way, sufficient flow velocity in the discharge pipe 25 is assured and danger of blockage is avoided.

To decrease the amount of splashing and noise, caused by the waste water discharging from the discharge opening 29 an impact surface 32 having a curved contour corresponding to the arcuate path of movement of the discharge opening 29 is provided onto which the water impinges after a short descent.

Figure 5:
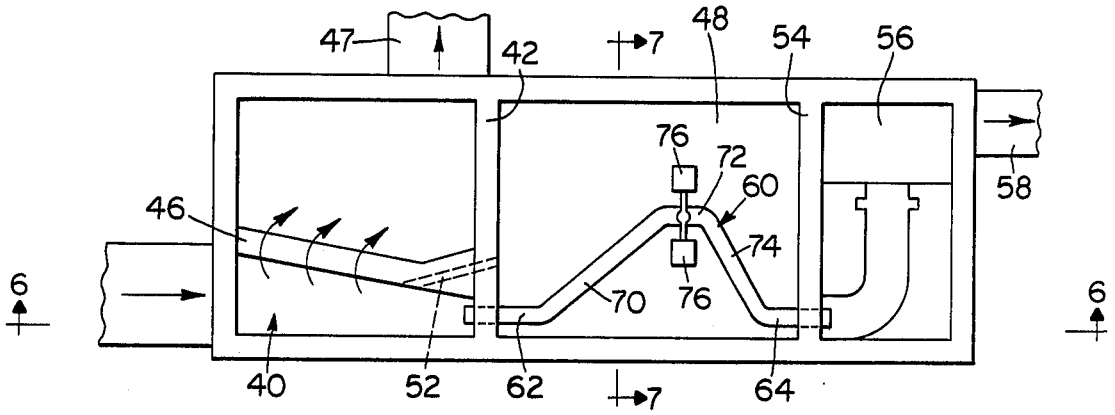
FIG. 5 is a top plan view showing another embodiment of our invention.
Figure 6:
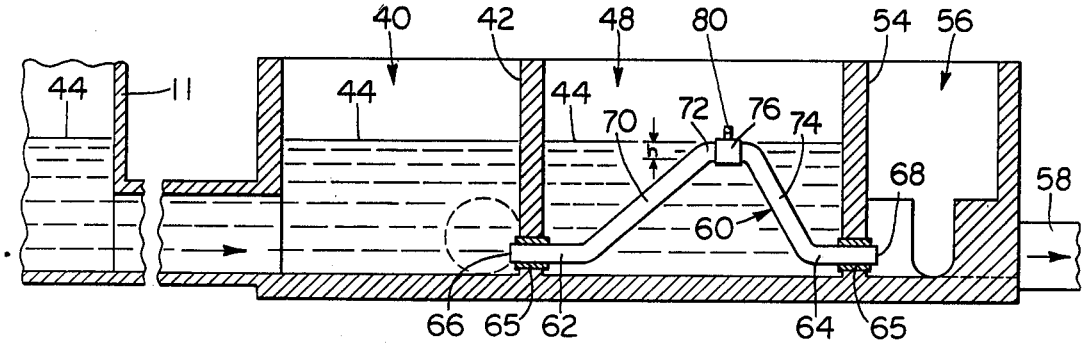
FIG. 6 is a sectional view taken generally along the line 6—6 of FIG. 5 and showing a fragment of a storm water retention tank.
Figure 7:
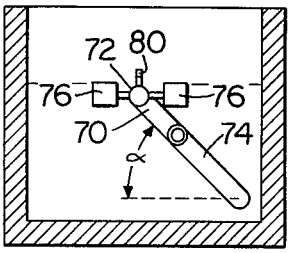
FIG. 7 is a sectional view taken generally along the line 7—7 of FIG. 5.

In accordance with the embodiment shown in FIGS. 5 through 7, we show a discharge chamber 40 which communicates with a storm water retention tank 11 of a treatment plant. The discharge chamber 40 is provided with an overflow weir 46 which determines the maximum height of the liquid level 44 in the discharge chamber 40. In this case, the waste water flowing over the overflow weir 46 passes by a channel or conduit 47 to a receiving water channel of course. A wall 42 separates the discharge chamber 40 from an intermediate chamber 48 which communicates with the discharge chamber 40 by a channel or conduit 52 so that the same liquid level 44 is obtained in the chamber 48. A wall 54 separates the intermediate chamber 48 from a receiving chamber 56 having a discharge channel or conduit 58 which leads to a treatment plant, not shown.

The discharge chamber 40 communicates with the receiving chamber 56 by means of a generally U-shaped discharge pipe 60 which is mounted within the intermediate chamber 48, and is provided with horizontal coaxial end sections 62, 64 which extend through the walls 42 and 54, respectively. The end sections 62 and 64 are axially aligned with each other and are supported by means of sealing bearing bushings 65 so that the inlet opening 66 of the discharge pipe 60 is in the vicinity of the base of the discharge chamber 40 and its discharge opening 68 is in the vicinity of the base of the receiving chamber 56. The discharge pipe 60 is mounted for pivotal movement in the intermediate chamber 48 and has an angled riser section 70 which communicates with a descending section 74 by an intermediate apex section 72. Two moving floats 76 are carried by the apex section so that the pivotally mounted U-shaped discharge pipe 60 follows the fluctuations of the liquid level 44 and the inner overflow surface of the apex section 72 always lies at a constant height difference "h" below the liquid level 44. In this way, a constant withdrawal of liquid over a time period is thus obtained from the discharge chamber 40 and also from the storm water retention tank 11. To prevent the U-shaped discharge pipe 60 from acting as a siphon, ventilation by means of a ventilation pipe 80 is provided in the apex section 72 of the discharge pipe 60. As shown in FIG. 6, the ventilation pipe 80 extends above the liquid level 44.

The length and sizes of the individual sections of the discharge pipe 60 are so dimensioned that the angle of inclination α of the riser section 70 of the discharge pipe 60 relative to the horizontal plane passing therethrough is no greater than 45°, even when the liquid level 44 is at a maximum. As shown in FIGS. 5 and 6, the descending section 74 of the discharge pipe 60 extends downward so as to define a greater included angle relative to the pivot axis of the apex section 72 than the riser section 70.

In accordance with the embodiment shown in FIGS. 8 to 10 the apparatus for regulating the discharge is not located within a discharge structure positioned downstream of the water retention tank 11, but is positioned directly within the tank 11 itself. As illustrated in FIGS. 8 and 9 we provide a U-shaped discharge pipe 82 having an inlet end 84 and an outlet end 86 both of which are pivotally mounted adjacent the tank base on a shaft 88, which is mounted for rotation in two bearing assemblies 90, which may be sleeves of polyamide, secured to the tank base. The discharge end 86 of the discharge pipe 82 extends through a sealing unit 92 mounted in the wall 94 of the tank 11 to provide a seal which also permits pivotal movement of the outlet end 86. The unit 92 is provided with a discharge opening 96 and a suitable shut-off valve 97 is provided in the unit 92 ahead of the opening 96. The actual U-shaped section of the discharge pipe 82 consists of a straight line riser section 98 and a descending straight line section 99 which are connected to each other by an apex section 100. The apex section 100 is supported by two floats 102 so that the pivotally mounted U-shaped discharge pipe 82 follows the fluctuations of the liquid level 104 in the tank 11 and the height difference "h" between the highest point of the inner overflow section of the apex section 100 and the liquid level 104 always remains constant, thus providing a constant liquid withdrawal over a period of time through the discharge pipe 82. To avoid siphoning effects, the apex section 100 of the discharge pipe 82 is ventilated by means of a ventilating pipe 106. In FIG. 9 the maximum positions of the floats 102 and of the descending section 99 of the discharge pipe 82 are shown in solid lines and the lowest possible positions of these components are shown in dotted lines at 99' and 102'. It will thus be seen that our apparatus provides for a constant withdrawal of liquid over a very great height difference "H" of the liquid level 104 and 104'. Also, in accordance with this embodiment the angle of inclination of the riser section 98 of the discharge pipe 82 in no greater than 45° even in the maximum position.

As shown in FIG. 10, the sealing unit 92 for the discharge end 86 of the discharge pipe 82 comprises a pipe section 108 which is secured rigidly within the tank wall 94 and is sealed by a sealing sleeve 107. The pipe section 108 is provided with a shut-off valve 97 ahead of the discharge opening 96. The discharge end 86 is mounted for rotation within the pipe section 108 and suitable sealing rings 109 are provided between the discharge end 86 and the pipe section 108.

As shown in FIG. 8, the riser section 98 has a smaller internal diameter than the descending section 99. For example, the internal diameter of the section 98 may be 150 mm while the internal diameter of section 99 may be 200 mm. The change-over between both diameters occurs at the apex section 100, preferably in front of the ventilating pipe 106. By this variation of the diameter, greater efficiency of the device can be obtained. Apart from using different pipe diameters, the change in diameters is possible by other means, for example, by fitting a diaphragm in the vicinity of the apex section 100.

Instead of the pivoting bearing, as shown in FIG. 10, flexible pipe connections such as, for example, hose sections, bellows or the like may be employed.

FIG. 11 shows a further embodiment in which, instead of a rigid pivoting pipe section, a flexible discharge pipe, bent in the shape of a U, is employed. The discharge pipe 110 is in the form of a flexible hose and has an inlet opening 112 which is anchored at the tank base 116 by a clamp 114. A riser section 118 is inclined upwardly from the inlet opening 112 and extends to an apex section 120 of the discharge pipe or hose 110 and is then bent in the shape of a U to provide a descending section 122 which extends downwardly to a discharge end 124 which passes through an opening in the tank wall 127 having a suitable seal therebetween. The apex section 120 is supported by two floats 126 so that it can follow the fluctuations of the liquid level 128 in the tank due to the flexibility of the discharge pipe 110. It will thus be seen that a constant height difference "H" is maintained between apex section 120 and the water level 128. An upstanding ventilation pipe 129 is provided in the apex section 120, as shown.

The inlet end 112 of the flexible pipe 110 does not need to be rigidly anchored at the tank base. That is, it may be carried by suitable means so as to move horizontally relative to the tank base 116. By such an arrangement it would be possible to cover a greater area of the tank base with the inlet opening 112 and thus avoid accumulation of sedimentation thereon.

While the embodiments described and illustrated all have a direct float control, and are therefore very simple of construction and operation and require no power supply, it will be apparent that with the embodiments shown in FIGS. 1 to 9, pivotal movement of the discharge pipe may be obtained by means of a positioning drive unit which is controlled by a suitable control unit actuated by the fluctuations of the liquid level.

It will also be apparent that the connection between the floats and the discharge pipe should preferably be adjustable so that the height difference "h" between the maximum apex height of the discharge pipe and the liquid level can be set as required. In this way, a liquid quantity to be withdrawn per time unit can be set. Also, the connection between a positioning drive unit and the discharge pipe could be adjustable.

What we claim is:

1. Apparatus for the continuous constant discharge of liquid from a container therefor having a discharge pipe with the inlet thereof located in the container and the outlet thereof located outside of the container and with the liquid flow therethrough being controlled by a control unit operating as a function of the liquid level in the container, the improvement in that said discharge pipe is generally U-shaped and both ends thereof are located in the vicinity of the floor of said container and has an ascending riser section between said inlet and said outlet with said riser section extending upwardly to an apex section at the base of the U-shaped discharge pipe to define an overflow for the liquid, and control means operatively connected to said discharge pipe to adjust and control the height of said riser section of the discharge pipe in response to fluctuations of the liquid level in said container to maintain said overflow for the liquid at a constant elevation below said liquid level in said container.

2. Apparatus as defined in claim 1 in which said discharge pipe is in the form of a flexible connection with the inlet and outlet thereof located in the vicinity of the floor of the container.

3. Apparatus as defined in claim 1 in which said control means has a unit for sensing the height of the liquid level in said container and an adjusting actuator for the movable section of the discharge pipe.

4. Apparatus as defined in claim 1 in which a float is connected to said base of the U-shaped discharge pipe.

5. Apparatus as defined in claim 1 in which ventilation means is carried by said base of the U-shaped discharge pipe.

6. Apparatus as defined in claim 1 in which said base of the U-shaped discharge pipe is enlarged in diameter adjacent one end and is connected at said one end to said descending section for said discharge pipe with the other end of said base being reduced in diameter and connected to a riser section for said discharge pipe.

7. Apparatus as defined in claim 6 in which the descending section of the U-shaped discharge pipe has a greater diameter than the riser section.

8. Apparatus as defined in claim 1 in which the descending section of the U-shaped discharge pipe defines a greater included angle relative to the base thereof than the riser section.

9. Apparatus for the continuous constant discharge of liquid from a container therefor having a discharge pipe with the inlet thereof located in the container and the outlet thereof located outside of the container and with the liquid flow therethrough being controlled by a control unit operating as a function of the liquid level in the container, the improvement in that the inlet of said discharge pipe is located in the vicinity of the floor of said container and has an ascending riser section between said inlet and said outlet with said riser section extending upwardly to an apex section outwardly of said container and into a receiving chamber which is separated from said container to define an overflow for the liquid which is located within said apex section, control means operatively connected to said discharge pipe to adjust and control the height of said riser section of the discharge pipe in response to fluctuations of the liquid level in said container to maintain said overflow for the liquid at a constant elevation below said liquid level in said container, and an impact surface is provided in said receiving chamber onto which the liquid falls with said impact surface having a curved contour corresponding to the path of movement of said overflow in said apex section.

* * * * *